US008898995B2

(12) United States Patent
Potts et al.

(10) Patent No.: US 8,898,995 B2
(45) Date of Patent: Dec. 2, 2014

(54) PLUG ASSEMBLY AND A METHOD FOR SEALING A HOLE

(71) Applicants: Keith Thomas Potts, Hartland, MI (US); Sherrill Dean Teaster, Fowlerville, MI (US)

(72) Inventors: Keith Thomas Potts, Hartland, MI (US); Sherrill Dean Teaster, Fowlerville, MI (US)

( * ) Notice: Subject to any disclaimer, the term of this patent is extended or adjusted under 35 U.S.C. 154(b) by 0 days.

(21) Appl. No.: 13/815,384

(22) Filed: Feb. 27, 2013

(65) Prior Publication Data

US 2014/0182237 A1 Jul. 3, 2014

Related U.S. Application Data

(62) Division of application No. 12/807,639, filed on Sep. 11, 2010, now Pat. No. 8,418,423.

(51) Int. Cl.

| | |
|---|---|
| ***E04B 1/00*** | (2006.01) |
| ***E04G 23/02*** | (2006.01) |
| ***E02D 37/00*** | (2006.01) |

(52) U.S. Cl.

CPC ..... *E04G 23/0203* (2013.01); *E02D 37/00* (2013.01)

USPC ..... 52/741.4; 52/514.5

(58) Field of Classification Search

USPC ..... 52/741, 514, 514.5, 573.1, 1, 704

See application file for complete search history.

(56) References Cited

U.S. PATENT DOCUMENTS

| | | | | | |
|---|---|---|---|---|---|
| 1,206,306 | A | * | 11/1916 | Crane | 277/538 |
| 3,933,332 | A | | 1/1976 | Louisa | |
| 3,993,103 | A | | 11/1976 | Hammer | |
| 4,016,696 | A | | 4/1977 | Mess | |
| 4,208,030 | A | | 6/1980 | Wilson | |
| 4,366,284 | A | * | 12/1982 | Ishido et al. | 524/447 |
| 4,754,590 | A | | 7/1988 | Gordon | |
| 4,760,868 | A | * | 8/1988 | Saxon | 138/89 |
| 4,807,415 | A | | 2/1989 | Oak | |
| 4,982,764 | A | * | 1/1991 | Saxon | 138/89 |
| 5,103,615 | A | | 4/1992 | Owens | |
| 5,665,114 | A | * | 9/1997 | Weadock et al. | 623/1.34 |
| 5,881,523 | A | | 3/1999 | Quatrochi | |
| 5,992,858 | A | | 11/1999 | Teaster | |
| 6,481,174 | B1 | | 11/2002 | Munger et al. | |
| 6,541,106 | B1 | | 4/2003 | Von Fay et al. | |
| 6,837,473 | B2 | | 1/2005 | Pekau | |
| 8,418,423 | B1 | | 4/2013 | Potts et al. | |
| 2007/0088296 | A1 | * | 4/2007 | Leeflang et al. | 604/265 |
| 2009/0025328 | A1 | * | 1/2009 | Hemminger et al. | 52/514 |
| 2012/0279600 | A1 | * | 11/2012 | Kiest, Jr. | 138/97 |

* cited by examiner

*Primary Examiner* — Basil Katcheves

(74) *Attorney, Agent, or Firm* — John G. Chupa

(57) ABSTRACT

A dual stage plug assembly 10 which provides a first sealing stage which is cooperatively provided by the insertion members 12, 14 (including the unexpanded portion 24) and a second sealing stage which is provided by selectively expandable member 24. The plug assembly 10 is selectively inserted into a hole, such as hole 80, which is formed in a tangible entity, such as basement wall 82, and the members 12 and 14 cooperates with member 24 to seal the hole 80, thereby preventing water and/or other liquid from entering and passing through the hole 80.

4 Claims, 2 Drawing Sheets

PLUG ASSEMBLY AND A METHOD FOR SEALING A HOLE

This is a Divisional of pending U.S. application Ser. No. 12/807,639 which was filed on Sep. 11, 2010 and from which priority is claimed.

GENERAL BACKGROUND

1. Field of the Invention

The present inventions generally relate to a plug assembly and to a method for sealing a hole and more particularly, to an assembly and a method by which a hole, such as by way of example and without limitation, a hole in a wall, is selectively sealed in a two or multi stage manner.

Background of the Invention

Holes occur in various structures and other tangible entities, such as by way of example a wall (e.g., a basement wall). It should be appreciated that the term "hole" or "holes", as used throughout this specification, each refer to any type of undesirable opening within a structure or other tangible entity. Such an undesirable opening may be in the form of a crack, crevice, hole, or in any other form and nothing in this description is meant to or does limit the present inventions to a particular type of opening or to a particular type of tangible entity.

These holes typically allow for the undesirable flow of water and/or other liquids into and through the structure or entity into which they occur, and such water and/or other liquids typically are then undesirably communicated into some other environment. For example, holes which occur in a basement wall typically and undesirably allow for the communication of water into a basement environment.

Various strategies have been and are employed to "plug" or seal these holes and such strategies include placing an item (e.g., a cork) into the hole and/or filling the hole with some epoxy or other material. These strategies have several drawbacks. As used in this specification the term "plug" is meant to refer to anything which acts to seal or partially seal a hole.

By way of example and without limitation, simply placing an item into the hole does not adequately seal the entire hole, and water and other liquids continue to flow through the "unsealed" portion of the hole. Placing epoxy or similar types of flowable material into the hole is time consuming, messy, and provides an overall undesirable appearance. Moreover, many of these materials are poisonous and quickly degrade over time (especially in a relatively damp environment), thereby requiring the originally placed materials to be removed and replaced.

There is therefore a need for a new and improved hole sealing or plug type assembly and to a method for sealing a hole, and the present inventions provide such a new and novel strategy which overcomes some or all of the previously delineated drawbacks.

SUMMARY OF THE INVENTION

It is a first non-limiting object of the present inventions to provide an assembly for selectively sealing a hole and which overcomes some or all of the previously delineated drawbacks of prior sealing assemblies.

It is a second non-limiting object of the present inventions to provide a method for sealing a hole and which overcomes some or all of the previously delineated drawbacks of prior sealing methods.

According to a first non-limiting aspect of the present inventions, a plug assembly is provided and includes a first insertion portion; and a second sealing portion which is coupled to the first insertion portion.

According to a second non-limiting object of the present inventions, a plug assembly is provided and includes an insertion member having a first hardness and having a cavity and a first longitudinal axis of symmetry; a coupling member which has a body portion and a first end portion which selectively and movably resides within the cavity, wherein the coupling member includes a second longitudinal axis of symmetry which overlays the first longitudinal axis of symmetry, wherein the first end portion couples the coupling member to the insertion member; and an expansion member which expands upon contact with water and which surrounds the body of the coupling member and which further includes a third longitudinal axis of symmetry which overlays each of the first and second longitudinal axes of symmetry and wherein the expansion member has a second hardness which is less than the first hardness.

According to a third non-limiting aspect of the present inventions, a method for sealing a hole in a wall through which water flows is provided. The method includes the steps of obtaining a member; placing water expandable material about a portion of the member; forcing the member into the hole, thereby causing the member to frictionally reside within the hole; and allowing the water to contact the material, thereby allowing the material to expand within the hole, whereby the expanded material and the member cooperatively seal the hole and prevent the water from flowing through the hole.

These and other features, aspects, and objects of the various present inventions will become apparent from a reading of the detailed description of the present inventions, including by reference to the subjoined claims, and by reference to the attached drawings.

DETAILED DESCRIPTION OF THE PREFERRED EMBODIMENT OF THE INVENTIONS

Figure 1:
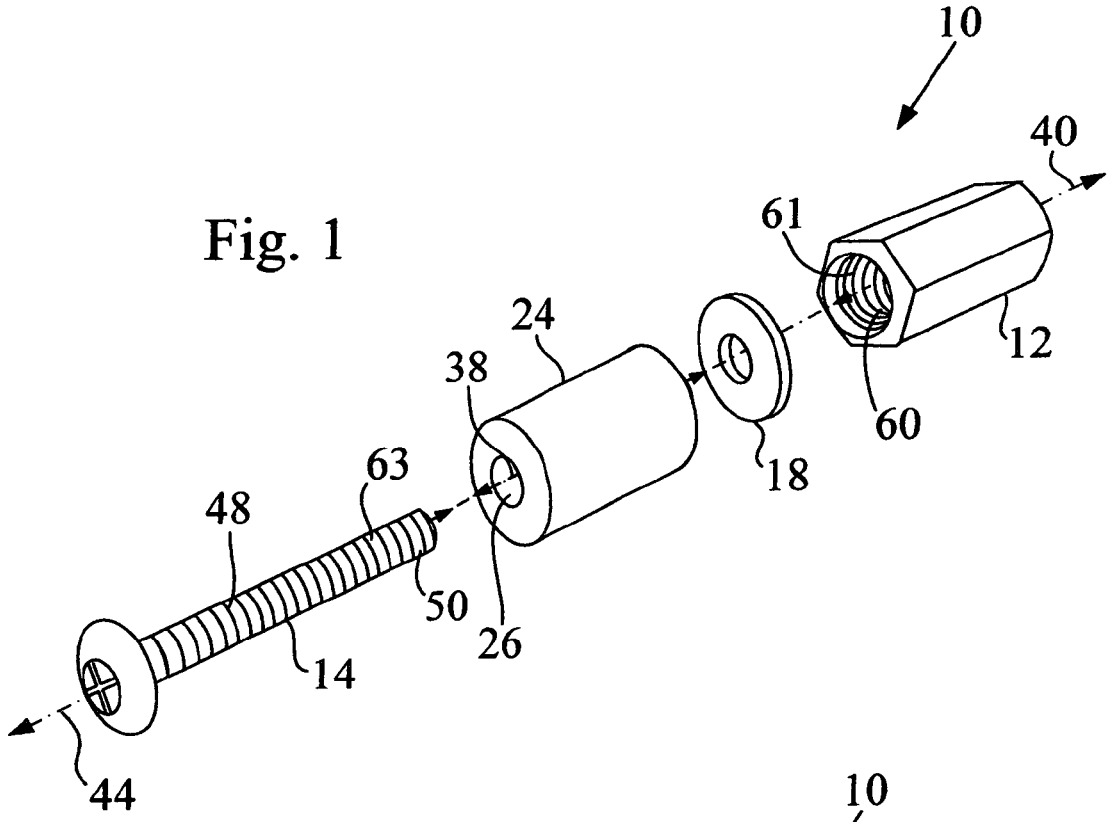
FIG. 1 is a perspective unassembled view of a plug assembly which is made in accordance with the teachings of the preferred embodiment of the various inventions.
Figure 2:
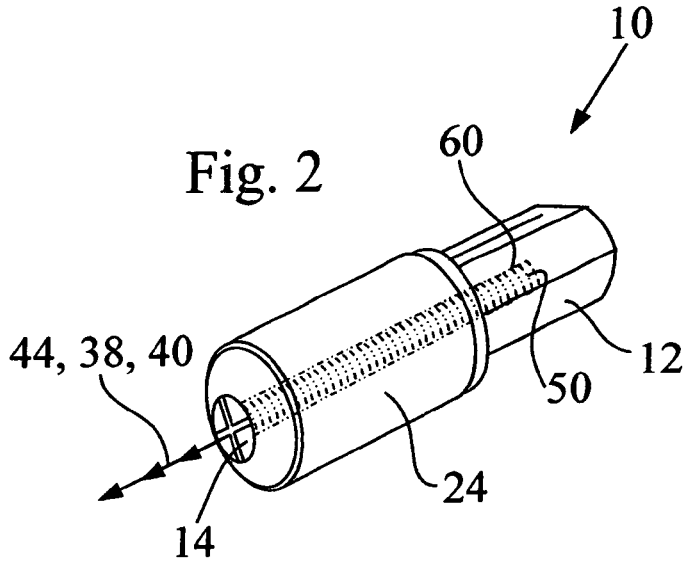
FIG. 2 is a perspective assembled view of the plug assembly (part of which is shown) which is shown in F*igure* 1.

Referring now to FIGS. 1 and 2, there is shown a plug assembly 10 which is made in accordance with the teachings of the preferred embodiment of the various inventions.

Plug assembly 10 includes an insertion portion 12 which, in one non-limiting embodiment, comprises a commercially available "¼ inch×⅞ inch" 3 zinc plated coupling nut, and the thread count is 20. In this non-limiting embodiment, the portion 12 has a SKU of 37815 and a UNSPSC of 31161728. In this non-limiting embodiment, the diameter of portion 12 is about one quarter of an inch, the length is about ⅞ of an inch, and the material forming portion 12 is steel. Alternatively, portion 12 may be obtained from the Alma Bolt Company (a member of the ABC Fastener Group) and has a SKU number of 25UCN. Plug assembly 10 further includes a coupling member 14 which, in one non-limiting embodiment of the invention, comprises a commercially available "¼ inch×1½ inch Phillips Truss Head Machine 18-8 Stainless Steel Screw" which is available from the Fastenal corporation and which has a SKU of 0170593 and a UNSPSC of 31161504. In this non-limiting embodiment, the diameter of member 14 is about ¼ of an inch, the length is about 1½ inches and the thread count is 20. Alternatively, portion 14 may be obtained from the Alma Bolt Company and has a SKU Number of 25U150SSTXMS.

The plug assembly 10 further includes a flat washer 18 which, in one non-limiting embodiment of the invention, comprises a commercially available washer which is identified as a "¼ inch Alloy 20 Stainless Steel Flat Washer" and which is available from the Fastenal Corporation and which has a SKU of 0176288 and a UNSPSC of 31161807. In this non-limiting embodiment, the washer 18 has an inner diameter of about 0.285 inches and an outer diameter of about 0.625 inches and a thickness of about 0.050 inches. Alternatively, the washer 18 may be obtained from the Alma Bolt Company and has a SKU Number of 12SSFW.

The plug assembly 10 further includes a generally cylindrically shaped and hollow member 24 having a cavity 26. The member 24 is adapted to expand upon contact with water and/or another type of liquid and, in one non-limiting embodiment, is constructed from commercially available material which is commonly referred to as "Hydrotite" which is available from Greenstreak, Inc of St. Louis, Mo. It should be appreciated that the member 24 has a longitudinal axis of symmetry 38, that the insertion portion 12 has a longitudinal axis of symmetry 40, and that the coupling member 14 has a longitudinal axis of symmetry 44. Further, the hardness of the insertion member 12 is much greater than the hardness the member 24.

To assemble the plug assembly 10, the coupling member 14 is inserted into and through the cavity 26. In this manner, the body portion 48 of the member 14 resides within the cavity 26 but the end portion 50 protrudes from the cavity 26. The washer 18 is placed upon the protruding end portion 50 and the protruding end portion 50 is inserted into the insertion member 12. That is, the insertion member 12 includes a threaded cavity 60 and the protruding end 50 is threaded in a complementary manner to the threads included within the cavity 60. In this manner, the threads which are formed within the cavity 60 cooperate with the threads 63 which are formed upon the end 50 and this cooperation allows the end 50 to be selectively and "screwably" coupled to the insertion portion 50 and to fixedly remain within the cavity 60. In this assembly, each of the individual axes of symmetry 38, 40, 44 respectively overlay the other axes of symmetry 38, 40, 44.

Figure 3:
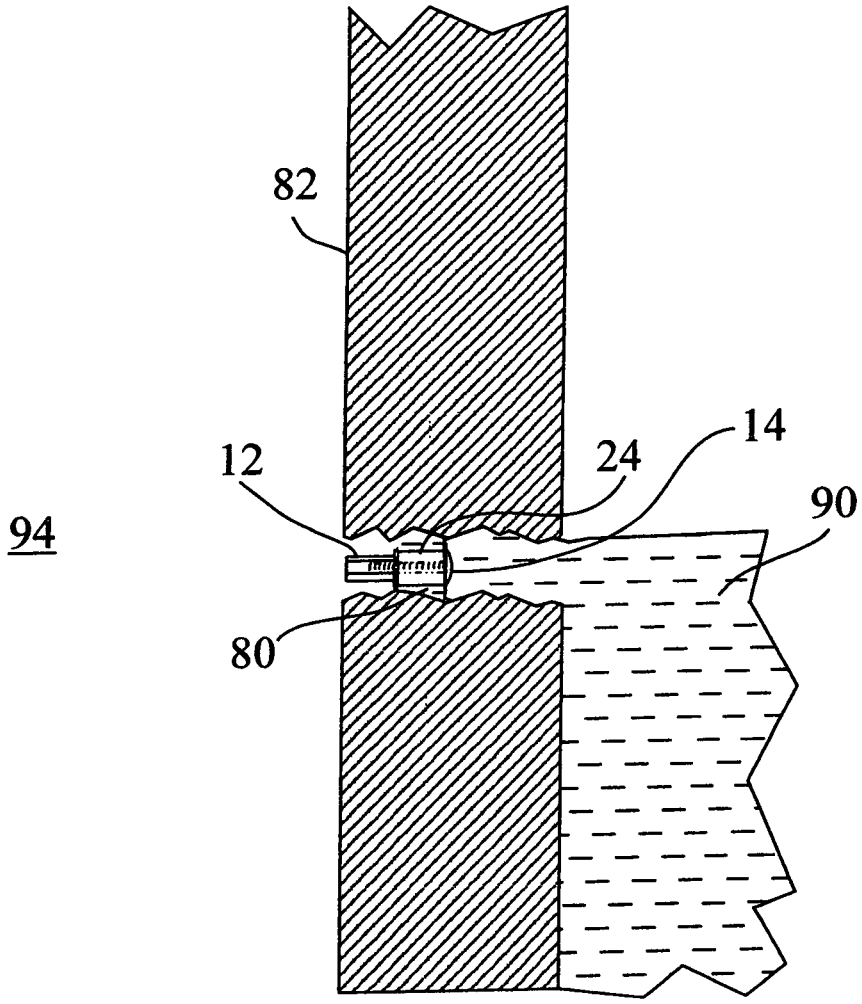
FIG. 3 is a side sectional view of wall into which the plug assembly which is shown in FIGS. 1 and 2 is selectively and operatively inserted and placed.

In operation, should a hole, such as hole 80 occur within a tangible entity, such as within basement wall 80 (see FIG. 3), the member 14 is initially forcibly placed within the hole 80, (most and possibly all of the assembly 10 is made to then reside within the hole 80 (see FIG. 3)), thereby providing a first stage of sealing the hole 80. That is, the mere presence of the member 14 (and all or most of assembly 10) within the hole 80 will slow or prevent the flow of liquid 90 into the hole 80 and through the hole 80 into the basement environment 94. Should some of the liquid 90 still pass through the hole 80, the flowing liquid 90 will contact the member 24 and cause the member 24 to physically expand (shown in phantom in FIG. 3) and to provided a second stage of sealing which is effective to fully seal the hole 82. Thus the members 14 and 24 each provide distinct and independent sealing functions and cooperatively allow the assembly 10 to provide and comprise a dual stage sealing assembly.

It is to be understood that the various inventions are not limited to the exact construction or embodiments which have been delineated above, but that various changes and modifications may be made without departing from the spirit and the scope of the following claims. It should be appreciated that the size and shape of assembly 10 (and of each of the individual components 12, 14, 18, and 24 may be modified as desired). Further it should be appreciated that member 10 may be formed as a single assembly without the need for the various previously delineated individual components 14, 12, 18, and 24.

What is claimed is:

1. A method for sealing a hole in a wall, said wall including a surface which abuts a liquid which flows throw said hole, said method comprising the steps of obtaining material which selectively expands when contracted by said liquid; forming said material in a cylindrical shape having a first longitudinal axis of symmetry; obtaining an insertion member having a hardness greater than the hardness of the formed material and having exposed ends and a second longitudinal axis of symmetry, wherein said insertion member has a plurality of internal threads and a hexagonal shaped body; obtaining a threaded member having second threads which are commentary to said internal threads; causing said threaded member to traverse said formed cylindrical shaped material and engage said internal threads of said insertion member, thereby attaching said formed expandable material to one end of said insertion member, whereby said first and said second longitudinal axes of symmetry are aligned; placing said formed expandable material within said hole and proximate to said liquid wherein said insertion member is distal from said liquid and wherein said formed expandable material is positioned between said liquid and said insertion member and wherein said formed expandable material impedes the flow of said liquid as said liquid travels through said hole and to said insertion member, whereby said formed expandable member provides a first primary seal of said hole within said wall and at least impedes said flow of said liquid in a direction to said insertion member.

2. The method of claim 1 wherein said member comprises a coupling nut.

3. The method of claim 2 wherein said water expanded material is in the form of a hollow cylinder.

4. The method of claim 1 wherein said water expandable material is placed upon said member is forced into said hole.

* * * * *